United States Patent [19]

Kurihara

[11] Patent Number: 4,988,268

[45] Date of Patent: Jan. 29, 1991

[54] AIR COMPRESSOR

[75] Inventor: Naoya Kurihara, Tokyo, Japan

[73] Assignee: Man Design Co., Ltd., Tokyo, Japan

[21] Appl. No.: 431,096

[22] Filed: Nov. 3, 1989

[30] Foreign Application Priority Data

Nov. 10, 1988 [JP] Japan ..... 63-146996

[51] Int. Cl.[5] ..... F04B 19/22; F04B 11/00; F01N 7/16

[52] U.S. Cl. ..... 417/312; 417/540; 181/246; 181/272

[58] Field of Search ..... 417/312, 540, 542; 62/296; 181/403, 246, 272

[56] References Cited

U.S. PATENT DOCUMENTS 2,091,499 8/1937 Brown ..... 417/540

4,793,775 12/1988 Peruzzi ..... 417/312

*Primary Examiner*—Leonard E. Smith

*Assistant Examiner*—John A. Savio, III

*Attorney, Agent, or Firm*—Nixon & Vanderhye

[57] ABSTRACT

An air compressor comprises an air-compressing section and a pulsation-absorbing tank which are arranged isolated from each other, a nozzle, provided for one of the compressing section and the pulsation-absorbing tank, for supplying compressed air from the compressing section into the pulsation-absorbing tank, and a flexible nozzle seal provided for the other one of the compressing section and the pulsation-absorbing tank and having a hole in the center thereof. One end of the nozzle is inserted in the hole of the nozzle seal. With the nozzle inserted in the hole of the nozzle seal, the nozzle seal is applied with the pressure of the air contained in either the air compressing section or the pulsation-absorbing tank and is thus brought into light contact with the outer periphery of the nozzle.

8 Claims, 3 Drawing Sheets

AIR COMPRESSOR

BACKGROUND OF THE INVENTION

1. Field of the Invention

The present invention relates to an air compressor, and more particularly to an air compressor comprising an improved connecting portion through which air is supplied from a compressing section to a pulsation-absorbing tank.

2. Description of the Related Art

Among various conventional air compressors, there is a type disclosed in Published Unexamined Japanese Utility Model Application (PUJUMA) No. 59-167976. FIG. 4 is a sectional view of the air compressor disclosed in this reference.

As is shown in FIG. 4, casing 3 in which both air-compressing section 1 and pulsation-absorbing tank 2 are arranged is made up of upper casing 3*a*, lower casing 3*b*, and cover 3*c*. Filter 7 is placed on the top of upper casing 3*a*, and is secured to upper casing 3*a* by cover 3*c*.

Lower casing 3*b* is fitted into upper casing 3*a*, and the fitted portion is hermetically sealed with sealant 8.

A plurality of supporting members 4 formed of an elastic material are arranged in lower casing 3*b*. Compressing section 1 is fixed to the tops of supporting members 4, and pulsation-absorbing tank 2 is fixed to longitudinally intermediate points of supporting members 4. In this manner, compressing portion 1 and pulsation-absorbing tank 2 are isolated from each other and are individually coupled to casing 3 through elastic supporting members 4. Therefore, vibration of compressing section 1 and that of pulsation-absorbing tank 2 are not transmitted directly to casing 3.

Compressing section 1 includes cylinder 10, and piston 11 which reciprocates inside cylinder 10. The air purified by filter 7 is supplied into the interior of compressing section 1 through air inlet port 14, and is compressed by the reciprocating motion of piston 11. After compression, the air is supplied into annular region 12 located around cylinder 10 by way of a discharge valve (not shown), and is then discharged into the exterior of compressing section 1 through discharge port 5.

The air discharged from compressing section 1 passes through connecting hose 6 and is supplied into pulsation-absorbing tank 2 by way of air-introducing port 9. The pulsating flow of the air compressed by compressing section 1 is absorbed by tank 2, so that smoothly-flowing compressed air can be obtained from air outlet port 15.

Connecting hose 6 mentioned above is fastened to both discharge port 5 and air-introducing port 9 by clamping rings 13.

Cushion 16 is adhered to the inner wall of upper casing 3*a*. By this cushion 16, casing 3 is prevented from contacting compressing section 1 even it is exerted with external force.

In regard to the construction and operating principles, compressing section 1 is similar to the compressing sections described in Published Examined Japanese Patent Applications (PEJPAs) No. 57-32226 and No. 57-30984. Therefore, a description of the construction and operating principles of compressing section 1 will be omitted herein.

The conventional air compressor mentioned above has the following problems:

In order to prevent vibration of compressing section 1 from being transmitted to pulsation-absorbing tank 2, connecting hose 6 (which connects discharge port 5 of compressing section 1 and air-introducing port 9 of tank 2 together) is formed of an elastic material, such as rubber. The ends of this hose 6 have to be fastened to discharge port 5 and air-introducing port 9, respectively, by clamping rings 13. It should be noted that this hose-fastening operation is troublesome to perform. In the case of mass production of air compressors, such a hose-fastening operation lengthens the fabrication time and is a laborious work to those engaged in the fabrication of the air compressors.

In order to prevent the air-passing noise from leaking from the interior of hose 6, this hose 6 should have a certain thickness. For example, the thickness of hose 6 should be 2 mm or more. However, if hose 6 has a great thickness, it inevitably becomes rigid, so that the initial intention of employing hose 6 (i.e., to prevent the vibration of compressing section 1 from being transmitted to pulsation-absorbing tank 2) is not attained. In order to attain the initial intention, hose 6 should not have a great thickness but should be extended. Alternatively, it should be provided with a complex-shape vibration-absorbing portion at an intermediate point thereof.

SUMMARY OF THE INVENTION

Accordingly, an object of the present invention is to provide an air compressor which is easy to fabricate and which has a construction allowing suppression of both the vibration and noise generated during operation.

This object is achieved by an air compressor comprising: an air-compressing section and a pulsation-absorbing tank which are arranged isolated from each other; a nozzle, provided for one of the compressing section and the pulsation-absorbing tank, for supplying compressed air from the compressing section into the pulsation-absorbing tank; and a flexible nozzle seal provided for the other one of the compressing section and the pulsation-absorbing tank and having a hole in the center thereof, into which hole one end of the nozzle is inserted. With the nozzle inserted in the hole of the nozzle seal, the nozzle seal are applied with the pressure of the air contained in either the air compressing section or the pulsation-absorbing tank and is thus brought into tight contact with the outer periphery of the nozzle.

In the present invention having the above construction, the nozzle and the elastic nozzle seal is brought into tight contact with each other, providing a hermetic condition therebetween, by merely inserting the nozzle into the hole of the nozzle seal.

The air compressed in the compressing section is supplied through the pulsation-absorbing tank not through an elastic hose but through the nozzle (which is formed of the same metallic material as that of either the compressing section or the tank). Therefore, the noise generated by the air passing through the nozzle hardly leaks from the interior of the nozzle.

In addition, the hermetically-sealed path connecting the compressing section and the pulsation-absorbing tank together is provided by merely inserting the nozzle in the hole of the nozzle seal and with no need to use clamping rings or the like. Therefore, the fabricating time of the compressor is short, and the labor requiring for the fabrication of the compressor can be lightened.

Moreover, the leakage of the noise generated by the air flow can be held at a low level without lengthening the path connecting the compressing section and the pulsation-absorbing tank. Further, the vibration of the compressing section is hardly transmitted to the tank.

DETAILED DESCRIPTION OF THE PREFERRED EMBODIMENTS

Figure 1:
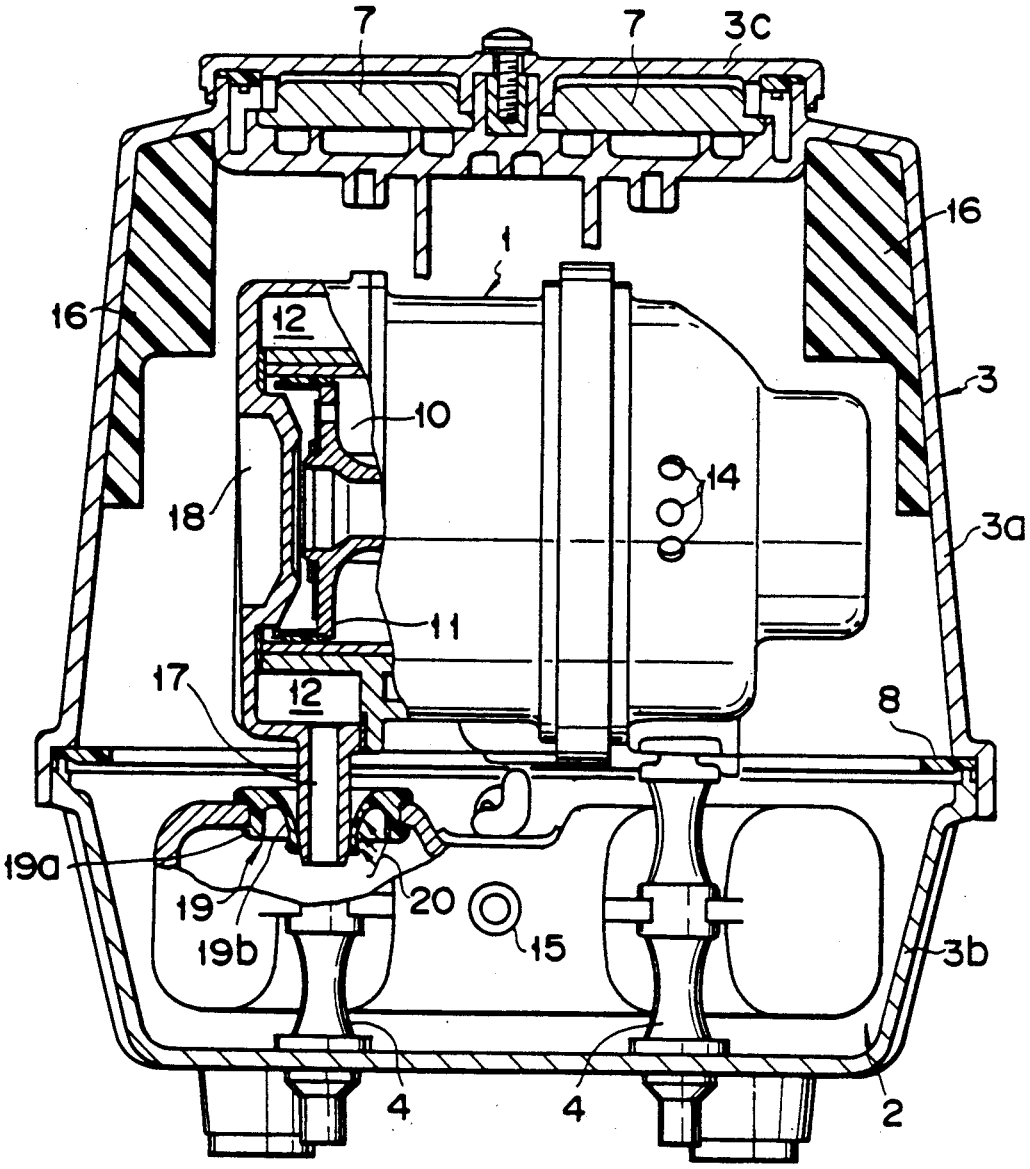
FIG. 1 is a sectional view of an air compressor according to one embodiment of the present invention.

The present invention will now be described in detail, with reference to the accompanying drawings. In FIG. 1, the same reference numerals as used in FIG. 2 denote the same or corresponding parts or components.

Referring to FIG. 1, casing 3 in which both air-compressing section 1 and pulsation-absorbing tank 2 are arranged is made up of upper casing 3*a*, lower casing 3*b*, and cover 3*c*. Filter 7 is placed on the top of upper casing 3*a*, and is secured to upper casing 3*a* by cover 3*c*.

Lower casing 3*b* is fitted into upper casing 3*a*, and the fitted portion is hermetically sealed with sealant 8.

A plurality of supporting members 4 formed of an elastic material are arranged in lower casing 3*b*. Compressing section 1 is fixed to the tops of supporting members 4, and pulsation-absorbing tank 2 is fixed to longitudinally intermediate points of supporting members 4. In this manner, compressing portion 1 and pulsation-absorbing tank 2 are isolated from each other and are individually coupled to casing 3 through elastic supporting members 4. Therefore, vibration of compressing section 1 and that of pulsation-absorbing tank 2 are not transmitted directly to casing 3.

Compressing section 1 includes cylinder 10, and piston 11 which reciprocates inside cylinder 10. The air purified by filter 7 is supplied into the interior of compressing section 1 through air inlet port 14, and is compressed by the reciprocating motion of piston 11. After compression, the air is supplied into annular region 12 located around cylinder 10 by way of a discharge valve (not shown), and is then discharged into the exterior of compressing section 1 through nozzle 17.

Cushion 16 is adhered to the inner wall of upper casing 3*a*. By this cushion 16, casing 3 is prevented from contacting compressing section 3 even it is exerted with external force.

As is shown in FIG. 1, nozzle 17, through which the compressed air is supplied from compressing section 1 into pulsation-absorbing tank 2, is integrally formed with housing 18 of compressing section 1. In other words, nozzle 17 constitutes part of compressing section 1.

Elastic nozzle seal 19 formed of rubber or the like is fitted in an opening formed in the upper portion of pulsation-absorbing tank 2. Nozzle seal 19 includes peripheral portion 19*a* fitted in the opening of tank 2, and central portion 19*b* which can extend into the interior of tank 2 and which is brought into tight contact with the outer wall of nozzle 17.

For fabrication, the tip end of nozzle 17 is inserted through central portion 19*b* of nozzle seal 19 such that the central axis of nozzle 17 and that of nozzle seal 19 are substantially aligned with each other. In this state, compressing section 1 and pulsation-absorbing tank 2 are positioned with reference to each other, and are then fixed to supporting members 4.

In the embodiment having the above construction, the air compressed by piston 11 reciprocating inside cylinder 10 is supplied from compressing section 1 to pulsation-absorbing tank 2 by way of nozzle 17.

The pressure of the air contained in tank 2 acts on the reverse side of central portion 19*b* of nozzle seal 19, i.e., on that side of central portion 19*b* which is opposite to the side in contact with nozzle 19. Therefore, central portion 19 and the outer wall of nozzle 17 are held in tight contact with each other, thus providing a hermetic condition between the two.

When the air pressure in tank 2 is not high, as in the initial stage of the operation of compressing section 1, the degree of contact between nozzle 17 and nozzle seal 19 is substantially the same as that at the time of the fabrication of the compressor. With an increase in the air pressure in tank 2, higher air pressure is applied to the reverse side of central portion 19*b* of nozzle seal 19, as is indicated by arrows 20 in FIG. 1, so that the degree of contact between nozzle 17 and central portion 19*b* of nozzle seal 19 is increased. With an increase in the pressure in tank 2, therefore, the degree of contact is increased, thereby providing a more reliable hermetic condition between nozzle 17 and nozzle seal 19.

Nozzle 17 and nozzle seal 19 are not limited to those shown in FIG. 1. Nozzle 17 and nozzle seal 19 are only required to tightly contact each other in response to the pressure of the compressed air contained in tank 2. As long as this requirement is satisfied, they may be modified in any manner. For example, they may be modified in the manners shown in FIGS. 2 and 3.

Figure 2:
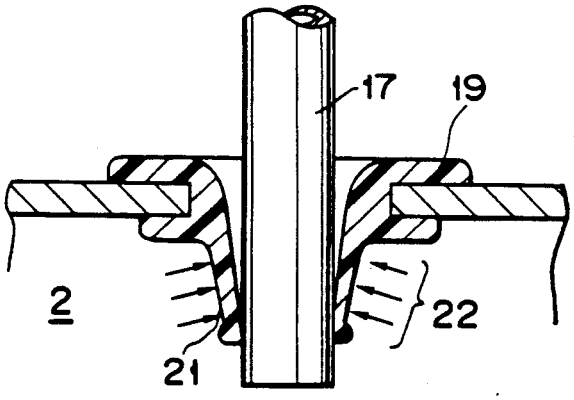
FIGS. 2 and 3 are sectional views each showing a modification of the nozzle seal employed in the compressor.

In the modification shown in FIG. 2, nozzle seal 19 has tapered portion 21. The pressure in pulsation-absorbing tank 2 is applied to tapered portion 21 in the manner indicated by arrows 22, whereby nozzle seal 19 is brought into tight contact with nozzle 17.

Figure 3:
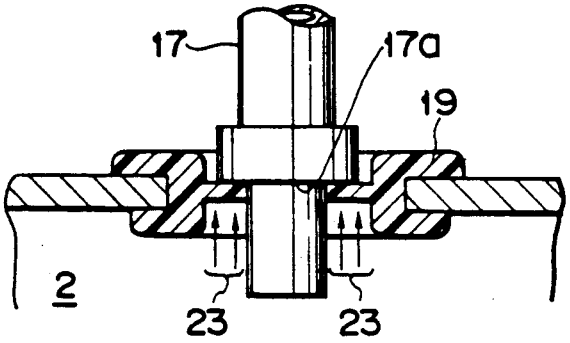
Figure 4:
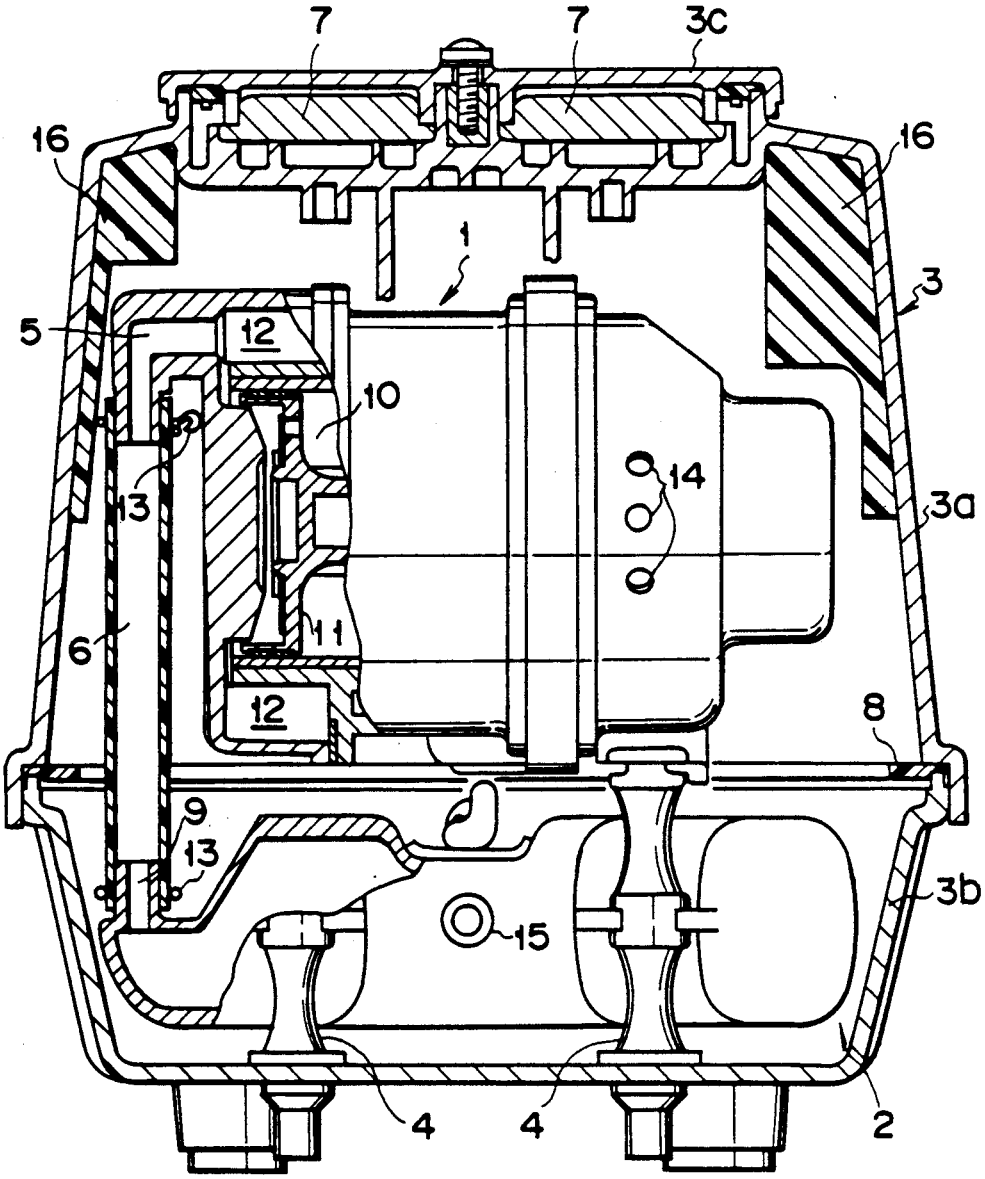
(PRIOR ART) F I G. 4
FIG. 4 is a sectional view of a conventional air compressor.

In the modification shown in FIG. 3, nozzle 17 includes a stepped portion having lower face 17*a*, and nozzle seal 19 includes a flat portion which is to be in tight contact with lower face 17*a*. The pressure in pulsation-absorbing tank 2 is applied to nozzle seal 19 in the manner indicated by arrows 23, whereby the flat portion of nozzle seal 19 is brought into tight contact with face 17*a* of the stepped portion.

In the air compressor of the above embodiment, the pressure of the compressed air is applied to nozzle seal 19 such that nozzle seal 19 is brought into tight contact with nozzle 17. Since a hermetic condition is provided by this tight contact, nozzle seal 19 need not be fixed to nozzle 17 by a clamping ring or the like.

In addition, nozzle 17 for connecting compressing section 1 and pulsation-absorbing tank 2 together is formed of a metallic material and is short, so that the noise generated by the air passing through nozzle 17 hardly leaks from nozzle 17.

Moreover, nozzle 17 is inserted through nozzle seal 19 formed of an elastic material, the vibration of compressing section 1 is absorbed by nozzle seal 19 and is therefore hardly transmitted to tank 2.

The above embodiment was described, referring to the case where nozzle 17 is provided for compressing section 1 and nozzle seal 19 is provided for pulsation-absorbing tank 2. However, the same advantages are brought about by providing nozzle 17 and nozzle seal 19 for tank 2 and compressing section 1, respectively.

What is claimed is:

1. An air compressor comprising:

a compressing section for compressing air and for thereby providing a source of pressurized air;

a pulsation-absorbing tank isolated from the compressing section for receiving pressurized air from said compressing section;

a nozzle, provided with one of the compressing section and the pulsation-absorbing tank for introducing the compressed and pressurized air from the compressing section into the pulsation-absorbing tank; and a nozzle seal provided operatively with another one of the compressing section and the pulsation-absorbing tank and having a hole defined within a central portion thereof, said nozzle having one end which is inserted into the hole defined within the nozzle seal so that said nozzle seal is in sealing contact with an outer periphery of said nozzle, wherein said nozzle seal includes flexible sealing means that is acted upon by pressure of said pressurized air contained in one of the compressing section and pulsation-absorbing tank and, in response to said pressure of said pressurized air, is flexibly urged into greater sealing contact with said outer periphery of the nozzle.

2. The air compressor according to claim 1, wherein said nozzle seal includes a tapered portion surrounding the outer periphery of the nozzle.

3. The air compressor according to claim 1, wherein said nozzle includes a flange portion having a lower face, and said nozzle seal includes a flat portion in tight contact with the lower face of the stepped portion.

4. The air compressor according to claim 1, wherein said nozzle is integrally formed with one of the compressing section and the pulsation-absorbing tank.

5. An air compressor comprising:

a compression section for compressing air to provide a source of pressurized air;

a tank section isolated from said compression section for receiving the pressurized air from the compression section;

a nozzle which establishes fluid-communication between said compression section and said tank section and which thereby allows said pressurized air to pass from said compression section and into said tank section; and a nozzle seal in sealing contact with said nozzle, said nozzle seal having flexible sealing means exposed to said pressurized air for being urged into greater sealing contact with said nozzle in response to being acted upon by said pressurized air to which said sealing means is exposed.

6. An air compressor as in claim 5, wherein said flexible sealing means includes a first surface portion in sealing contact with said nozzle, and a second surface portion, opposite said first surface portion, exposed to said pressurized air within said tank section, wherein said pressurized air within said tank section acts against said second surface portion to responsively cause said first surface portion to be urged into sealing contact with said nozzle.

7. An air compressor as in claim 6, wherein said first surface portion includes a tapered portion surrounding an outer periphery of said nozzle.

8. An air compressor as in claim 6, wherein said nozzle includes a stepped portion having a lower face, and wherein said first surface portion includes a flat portion in contact with said lower face of said stepped portion.

* * * * *